United States Patent [19]

Lin

[11] Patent Number: 4,950,958

[45] Date of Patent: Aug. 21, 1990

[54] ELONGATED, BENDABLE LAMP

[76] Inventor: Ta-Yeh Lin, 2F., No. 16, Central S. Rd., Sec. 2, Peitou, Taipei, Taiwan

[21] Appl. No.: 206,662

[22] Filed: Jun. 15, 1988

[51] Int. Cl.[5] ..... H05B 37/00

[52] U.S. Cl. ..... 315/185 R; 315/193; 315/323; 362/806

[58] Field of Search ..... 315/185 R, 185 S, 186, 315/192, 193, 210, 211, 323; 362/227, 251, 252, 806

[56] References Cited

U.S. PATENT DOCUMENTS 4,607,317 8/1986 Lin ..... 362/249

4,713,586 12/1987 Chiang ..... 315/186 X

*Primary Examiner*—Robert J. Pascal

*Attorney, Agent, or Firm*—Bacon & Thomas

[57] ABSTRACT

An elongated, bendable lamp is disclosed having at one of the ends a conventional lamp control switch. By means of the control exerted by the lamp control switch, a series of lamp operations, such as the unified switching on or off, twinkling, or a slow or quick interval switching on or off of the lamp in a forward or reverse direction can be conducted. The body of the lamp can be lengthened or shortened as desired by attaching other lamps or by cutting the lamp body.

4 Claims, 3 Drawing Sheets

ELONGATED, BENDABLE LAMP

BACKGROUND OF THE INVENTION

Decorative elongated lamps are known wherein the installation of a conventional lamp control switch provides a means by which a series of lamp motions, such as the unified switching on/off, twinkling, or a quick/slow interval switching lamp on/off in a forward or reverse direction. In addition to these improvements, it achieved improvements in installation, transportation and application over conventional neon lights. Therefore, it is regarded as a product of excellent quality. However, the known lamp has only one main conducting wire having an appropriate number of strands wires and a supplementary conducting wire having an appropriate number of strands installed in the interior of the body of the conventional lamp, without the installation of a series wire. Therefore, the supplementary conducting wire has to be cut and used as a series wire. Its length is also made and set at a specific length to serve this purpose, making it impossible to be cut or shortened after the lamp has been fabricated. In addition, it is also found to be quite inconvenient when it is being installed.

SUMMARY OF THE INVENTION

In view of the fact that no variation in length of the known lamp can be made at will, this invention provides an elongate, bendable lamp which can be cut in such a way that any length which is required can be achieved.

This invention is to provide a bendable lamp, by means of which the body of the lamp can be extended without any limit and can be integrally formed, so as to reduce the time required for its fabrication.

This invention also provides a bendable lamp that can be extended without any limit and be integrally formed, so as to simplify the fabrication process.

This invention is to still further provide a bendable lamp applicable to various character types or shapes.

This invention is to still further provide a bendable lamp, which will reduce the space to be occupied by the lamp, so as to cut down its transportation cost.

BRIEF DESCRIPTION OF THE DRAWINGS

The invention will be more readily understood from the following detailed description and disclosure, especially in light of the accompanying drawings, wherein its numerals refer to corresponding parts in the several diagrammatic views, in which.

BRIEF DESCRIPTION OF THE PREFERRED EMBODIMENT

Figure 6:
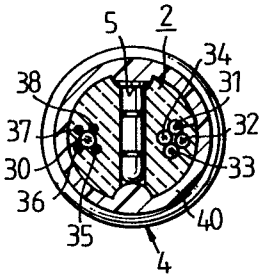
FIG. 6 is an enlarged cross-sectional view taken along line C–C in FIG. 5.
Figure 5:
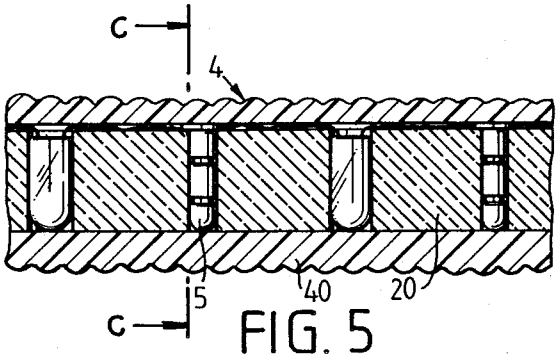
FIG. 5 is a partial enlarged, longitudinal sectional view taken along line B—B' in FIG. 3.

As shown in FIG. through FIG. 6, the elongated bendable lamp as presented by the invention is provided with body 20 having a pair of corresponding concave grooves 21, 22 and which has conducting wires 30–38 consisting of an appropriate number of strands on each of its lateral sides. The body 20 may be formed of a transparent or semitransparent PVC or similar plastic substance defining a plurality of holes into which a multiple number of conducting plugs 5 are inserted to connect in series with a plurality of intervally placed small light bulbs 1, or a multiple number of small light bulbs **1*a*–1*d*. After the divided small light bulbs 1*a*–1*d* located at the front and end positions of each section connected in series with each of the aforementioned conducting wires 30–38, or a layer of appropriate thickness of PVC or similar plastic having a soft or semi-soft texture is molded onto body 20 in the interior of the mold, forming the surface layer 40**.

Figure 7:
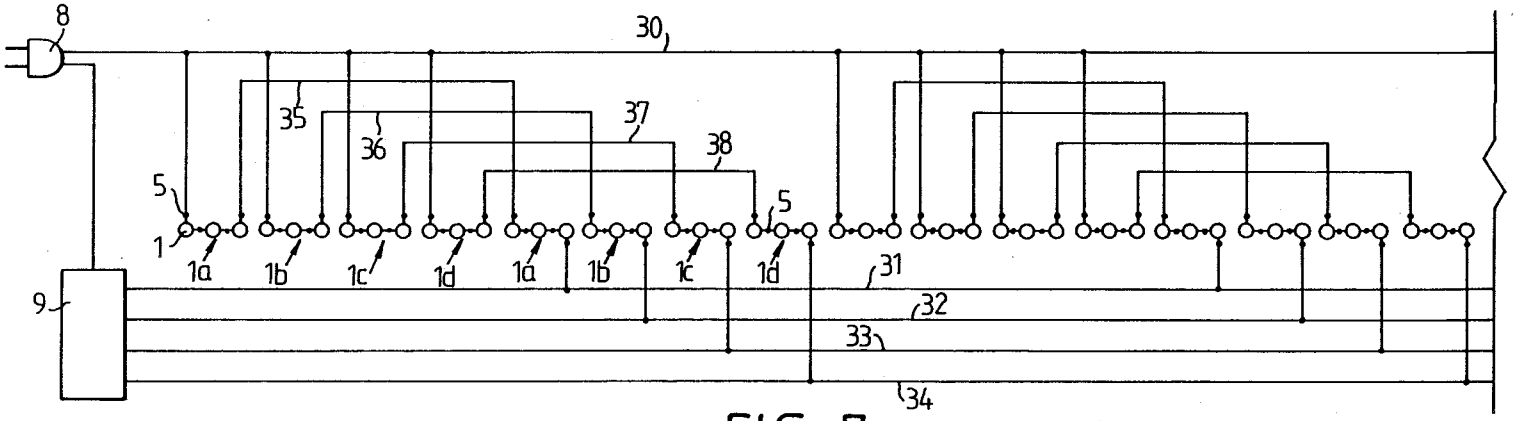
FIG. 7 is a schematic diagram of the circuit according to the invention.

The inner portion 2 of the body 20 is so designed that at one lateral side of which a main conducting wire 30 having an appropriate number of strands is connected in series with several series conducting wires 35, 36, 37 and 38 (for the purpose of connecting with the power supply) which have an appropriate number of strands. At another lateral side of the body there are several supplementary conducting wires 31, 32, 33 and 34 as a return circuit. According to the layout of circuit as shown in FIG. 7, three (or several) small light bulbs 1 are tightly inserted in the body in order, so that a series connection can be made by the conducting stoppers 5. The small light bulbs 1 which have been connected in series are divided into several sections **1*a*, 1*b*, 1*c* and 1*d* according to the order of the aforementioned series conducting wires 35, 36, 37 and 38. After that, the conducting stoppers 5 are used to conduct a series motion by arranging the aforementioned several sections of the series conducting wires according to a predetermined order, starting from the first section 1*a*, the second section 1*b* through the last section 1*d*. Conducting stoppers 5 are used to conduct at the same time a series motion on the several sections of the main conducting wires (as electric supply) and on the supplementary conducting wires 30, 31; 30, 32; 30, 33; and 30, 34** (as a return circuit).

Figure 1:
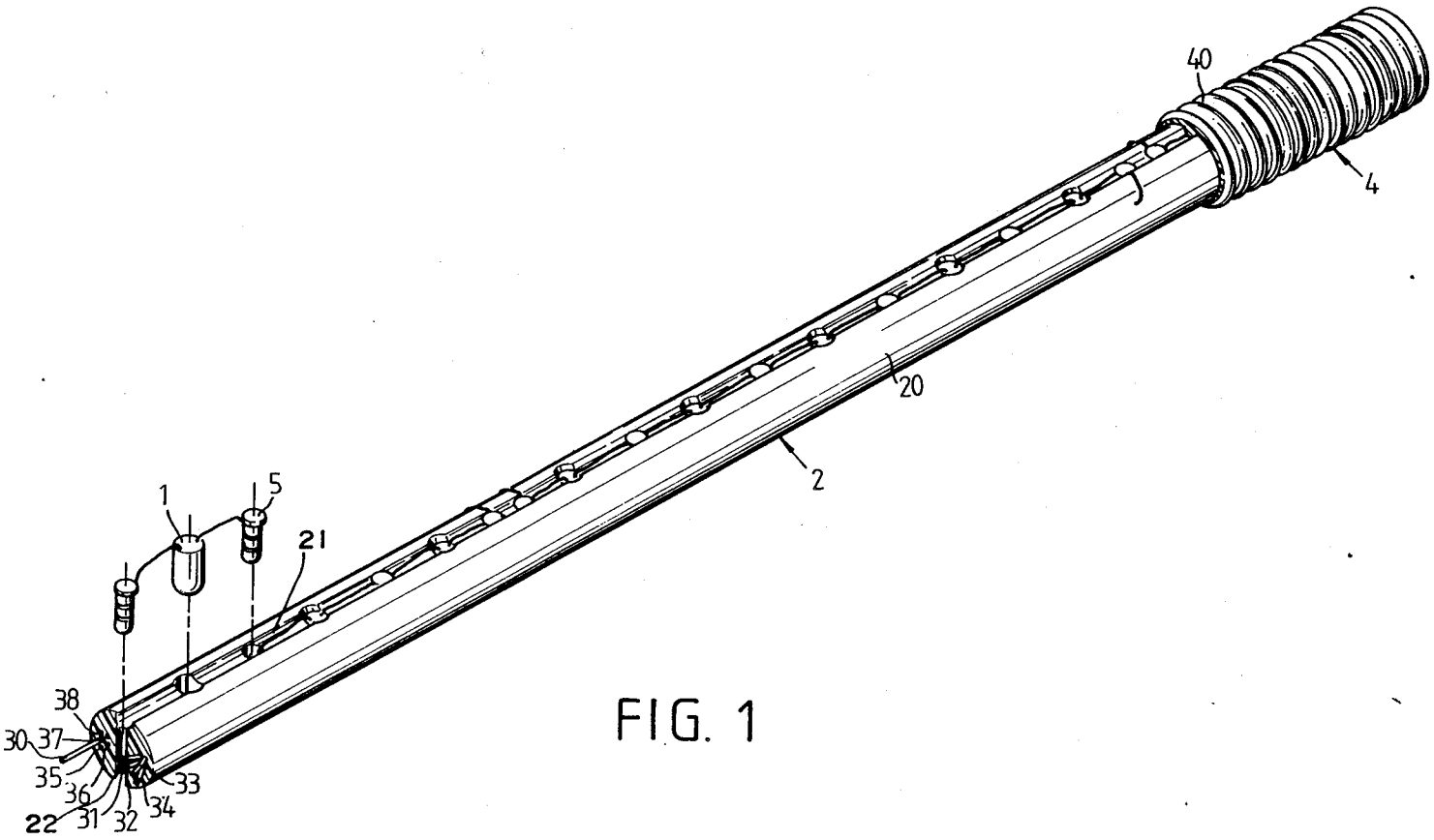
FIG. 1 is a sectional perspective view of the lamp according to the invention.
Figure 2:
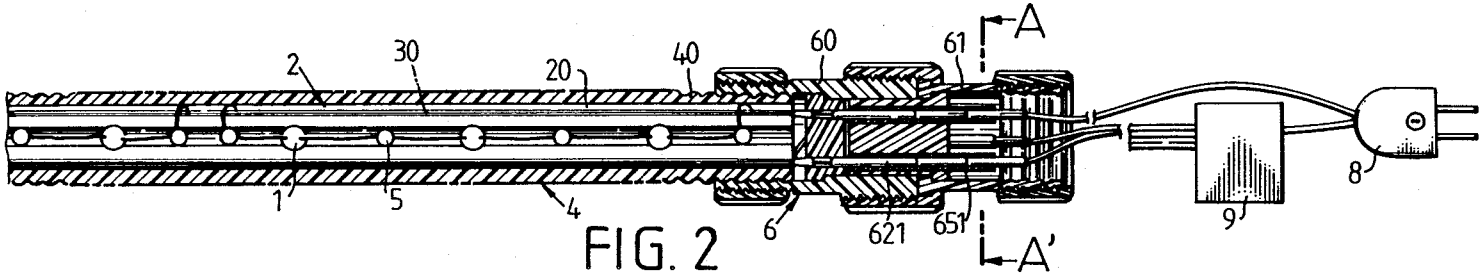
FIG. 2 is a longitudinal cross-sectional view of the lamp of FIG. 1 showing connecting fittings, a conventional switching control device and an electric supply plug.

As shown in FIG. 2 and FIG. 7, at the time of the installation of the bendable lamp 4, a connecting fitting 6 and a power plug 8 are installed at one end of the lamp. The power plug 8 connects with a power supply. A plurality (four or more) conducting pins 621 are separately set at a connecting plug 60 and the connecting socket 61 has a plurality (four or several) conducting sockets 651. A conventional switching on/off control device 9 may also be installed. Several main conducting wires (for the purpose of connecting with the power supply) and supplementary conducting wires (as a return circuit) 30, 31, 32, 33 and 34 can also be directly extended out from the bendable body 20 of the lamp, (for which three additional inventions are meanwhile being applied), on which the aforementioned switching on/off control device 9 of the lamp can be installed. However, another switch should be additionally installed. When the aforementioned installation has been duly completed and the plug 8 inserted into a socket of the power supply, the lamp 4 will, by means of the switching on/off control device 9, automatically exhibit a unified switching on/off twinkling motion, or a slow/-quick interval circulation motion in a forward or reverse direction. Plane surface decorative lamps or solid patterned lamp decorations can be formed by bending, connecting or nailing processes as indicated in examples shown in FIG. 1, FIG. 2 and FIG. 3. The lamps can be converted from the original motionless luminous bodies into a motional, luminous and attractive array.

Figure 3:
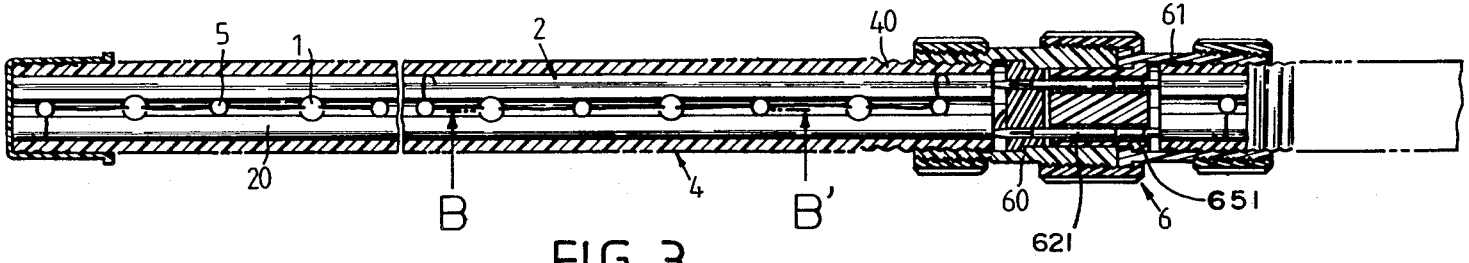
FIG. 3 is a sectional view of the invention illustrating the lamp according to the invention and a connecting filling to connect other lamps.
Figure 4:
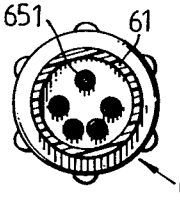
FIG. 4 is a cross-sectional view taken along line A—A', in FIG. 2.

The small light bulb sections can be connected together into an extremely long bundle. At the time of the application, the even number sections (such as 2,4, 6...) should be used as the cardinal number and be cut (shortened) at will in the position indicated by the imaginary line in FIG. 7. If it is to be further lengthened, additional lamps may be connected as indicated by FIG. 3, under which one section having a connecting fitting consisting of several conducting insertion pins 621 and conducting insertion rockets 651 will be employed to effect a connection, so as to achieve the objects of performing the desired motion.

I claim:

1. An elongated bendable lamp having a bendable lamp body defining a plurality of openings and a plurality of individual light bulbs disposed in the plurality of openings comprising:

(a) first electrical connection means electrically connecting a number of light bulbs in series wherein the number of light bulbs connected in series is less than the total number of light bulbs so as to divide the total number of light bulbs into a plurality of different sections;

(b) a main conducting wire extending through the bendable lamp body;

(c) a number of supplementary conducting wires extending through the elongated body wherein the number of supplementary conducting wires is equal to the number of different sections;

(d) second electrical connecting means electrically connecting a first light bulb in each of the different sections to the main conducting wire;

(e) third electrical connecting means electrically connecting a second light bulb in each of the different sections to one of the supplementary conducting wires such that each supplementary conducting wire is electrically connected to a different section; and, (f) plug means connected to the main conducting wire and the supplementary conducting wires and adapted to be connected to an electrical power source.

2. The elongated bendable lamp according to claim 1 further comprising lamp control switch means connected to each supplementary conducting wire and the plug means to selectively control the lighting sequence of the bulbs in each section.

3. The elongated bendable lamp according to claim 2 further comprising releasable coupling means releasably connecting the lamp body to the plug means and the lamp control switch means.

4. The elongated bendable lamp according to claim 3 wherein the releasable coupling means comprises:

(a) a connecting plug attached to the lamp body and having a plurality of electrical connecting pins attached to the main conducting wire and to each of the supplementary conducting wires;

(b) a connecting socket member having a plurality of connecting sockets connected to the plug means and the lamp control switch means; and, (c) means to releasably attach the connecting plug and the connecting socket member such that the connecting pins engage the connecting sockets.

* * * * *